United States Patent [19]

Karlsson

[11] Patent Number: 4,606,568

[45] Date of Patent: Aug. 19, 1986

[54] SIDE LIFTING APPARATUS

[75] Inventor: Jan Karlsson, Ryssby, Sweden

[73] Assignee: Kalmar LMV, Ljungby, Sweden

[21] Appl. No.: 679,743

[22] Filed: Dec. 10, 1984

[30] Foreign Application Priority Data

Jan. 4, 1984 [SE] Sweden ..... 8400036
Feb. 6, 1984 [SE] Sweden ..... 8400585

[51] Int. Cl.[4] ..... B66F 9/18

[52] U.S. Cl. ..... 294/81.4; 294/81.21; 414/607

[58] Field of Search ..... 187/9 R, 9 E; 414/607, 414/608, 785; 294/81.21, 81.4, 81.53; 267/20 A

[56] References Cited

U.S. PATENT DOCUMENTS

| | | | |
|---|---|---|---|
| 3,817,414 | 6/1974 | Peltonen | 214/621 |
| 3,870,180 | 3/1975 | Snelling | 214/621 |
| 4,093,090 | 6/1978 | Whiteman | 414/607 |
| 4,254,941 | 1/1981 | Charonnat | 294/81.4 X |
| 4,354,794 | 10/1982 | Macnab | 414/607 |
| 4,449,882 | 5/1984 | Perrott | 414/608 X |

FOREIGN PATENT DOCUMENTS

| | | | |
|---|---|---|---|
| 1303456 | 8/1962 | France | 267/20 A |
| 7206798 | 4/1974 | Sweden . | |

*Primary Examiner*—Joseph J. Rolla
*Assistant Examiner*—Nils E. Pedersen

[57] ABSTRACT

A side lifting apparatus is disclosed for detachable connection to a container from the side, arranged to be supported by the lifting stand of the fork truck to be raised and lowered along said lifting stand. The side lifting apparatus comprises a horizontal main girder and two vertical columns directed upwardly from the girder and rigidly mounted to its ends, each of said columns carrying a bearing housing having a downwardly directed locking pin arranged turnably in the bearing housing to be brought into locking engagement with a top corner fitting of the container. Each of said columns comprises an upper member carrying said locking pin, and a lower member rigidly mounted to the horizontal main girder. The lower and upper members of each column are axially displaceable in relation to each other in order to alter the distance of the locking pin to the main girder. When handling an inclined container the locking pins are thereby arranged, by extending the columns, to be set at different levels to each other, said difference in levels corresponding to the inclination of the container.

10 Claims, 8 Drawing Figures

SIDE LIFTING APPARATUS

FIELD AND BACKGROUND OF THE INVENTION

The present invention relates to a side lifting apparatus for detachable connection to a container and arranged to be supported by the lifting stand of a fork truck to be raised and lowered along the lifting stand.

When handling containers with the aid of a side lifting apparatus, the container is frequently not level, but inclines somewhat in relation to the support surface on which the truck with the side lifting apparatus is moved. Such an inclined container cannot be connected to the side lifting apparatus unless the inclination is compensated in some way. The problem has been solved earlier by a side lifting apparatus which, by means of an outer frame, is pivotably journalled on an inner support frame carried by the lifting stand of the truck, the outer frame having a vertically movable main girder with two turnable locking pins which are to be brought into engagement with the top corner fittings of the container. By turning the side lifting apparatus about a central fulcrum, the locking pins can be brought to different levels corresponding to the inclination of the container to be handled. Although the known arrangement solves the problem of handling inclined containers, it has several other deficiencies. The double frame arrangement required to achieve turning means that the side lifting apparatus is relatively heavy. The double frame arrangement in combination with the main girder being located at a high distance above the ground means that the side lifting apparatus will have a centre of gravity which is located extremely high. Furthermore, the construction elements of the side lifting apparatus are so located that the truck-driver's vision is extremely restricted, entailing difficulties in fast and accurate operation of the side lifting apparatus to a position for connection with the container. The high weight also necessitates more material and thus higher manufacturing costs. Furthermore, it is necessary to arrange the main girder vertically movable in relation to the outer frame so that the side lifting apparatus can be adjusted to containers of different heights. This complicates the construction and further increases the cost.

SUMMARY OF THE INVENTION

The object of the present invention is to provide an improved side lifting apparatus which can also be connected to an inclined container quickly and in a simple, reliable manner, and which is a considerable improvement with respect to the known side lifting apparatuses described above. Accordingly, the present invention resides in an improved side lifting apparatus comprising a horizontal main girder and two vertical columns directed upwardly from the girder and rigidly mounted to its ends, each of said columns carrying a bearing housing having a downwardly directed locking pin arranged turnably in the bearing housing to be brought into locking engagement with a top corner fitting of the container, each of said columns comprising an upper member carrying said locking pin and a lower member rigidly mounted to the horizontal main girder, said lower and upper members of each column being axially displaceable in relation to each other in order to alter the distance of the locking pin to the main girder, whereby when handling an inclined container the locking pins being arranged, by extending the columns, to be set at different levels to each other, said difference in levels corresponding to the inclination of the container.

According to a preferred embodiment the two members of each column are arranged to be displaced from each other upon connection to an inclined container, in that the bearing housing of the column, or a part thereof is impeded by the top corner fitting which is in the highest level and during continued lowering of the main girder, and, when the container is placed on an inclined support surface, in that the container lifts the corresponding upper column member in relation to the upper member of the other column. In this way the members of one column are automatically displaced as soon as the bearing housing is brought into abutment with the opposite top corner fitting of the container, and no special operating means are required to pre-adjust the upper member and lower member of each column in relation to each other corresponding to the inclination angle in question.

BRIEF DESCRIPTION OF THE DRAWINGS

The invention will be described further in the detailed description which follows, with reference to the accompanying drawings, in which.

DESCRIPTION OF ILLUSTRATED EMBODIMENTS

Figure 1:
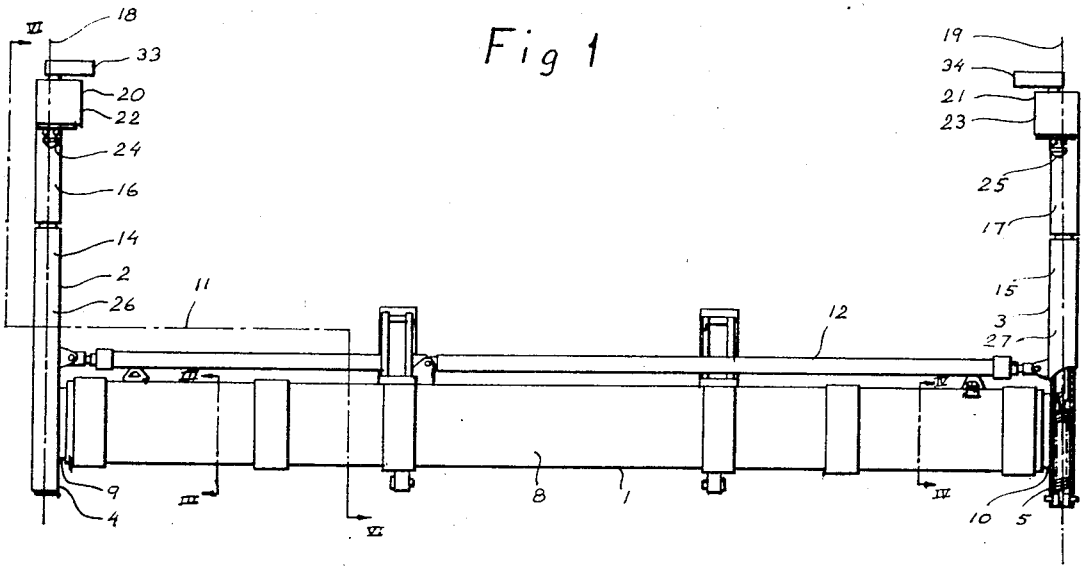
FIGS. 1 and 2 show a preferred embodiment of the side lifting apparatus according to the invention from the front and from above, respectively.
Figure 2:
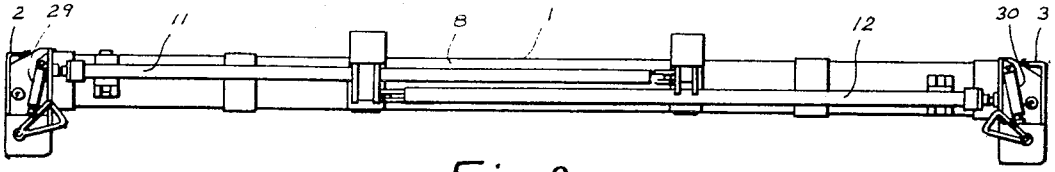
Figure 5:
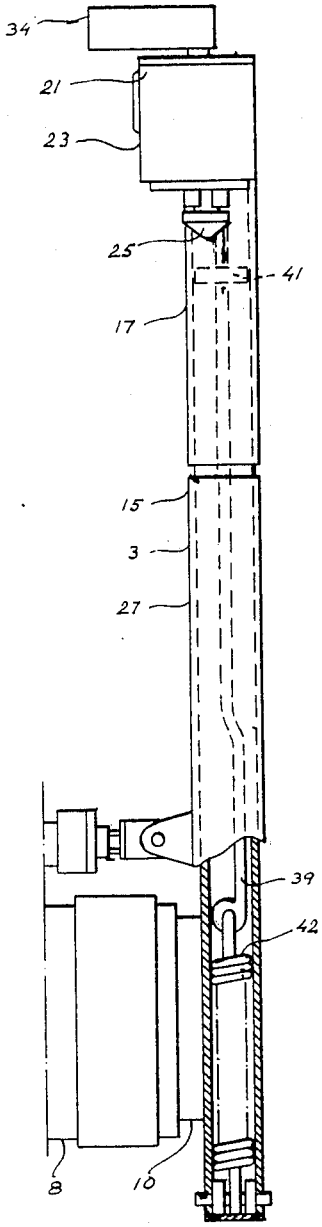
FIG. 5 shows the righthand column in FIG. 1 from the front, slightly enlarged and partly cut open.

With reference to FIGS. 1 and 2 it is shown therein a side lifting apparatus designed as an H or U shaped yoke consisting of a horizontal, elongate main girder 1 and two vertical columns 2, 3 extending upwardly from the main girder 1 at its ends, the lower parts of the columns extending downwardly a short distance past the main girder to form support legs 4, 5.

The side lifting apparatus is designed to be carried by the lifting stand 6 (FIG. 7) of a fork truck, and can be constructed either for a side carriage mounting or a fork shank system. It may even be designed for direct attachment to the lifting stand. The side lifting apparatus is especially designed for handling empty containers 7 having a length of 20, 30, 35 or 40 feet.

Figure 3:
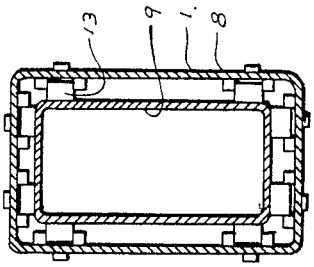
FIGS. 3 and 4 show cross sections of the side lifting apparatus along the lines III—III and IV—IV, respectively, in FIG. 1.
Figure 4:
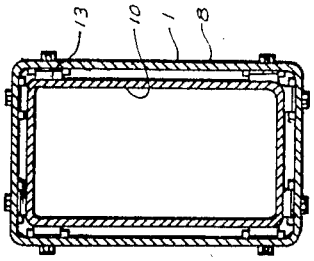

The main girder 1 consists of a hollow central section 8 and two hollow extension arms 9, 10 journalled telescopically therein and in each other. The extension arms 9, 10 carry the vertical columns 2, 3. A hydraulic cylinder 11, 12 is secured by one end to each column 2 and 3, respectively, and by the other end to the central section 8 to enable simultaneous parallel displacement of the columns 2, 3 out from and in towards the central section 8. The extension arms 9, 10, to which the columns 2, 3 are rigidly attached, are thereby drawn out from and inserted into the central section 8. As can be seen from FIGS. 3 and 4, the extension arms 9, 10 are slidably journalled in the central section 8 and in each other by means of suitable slide bearings 13.

The vertical columns 2, 3 are the mirror images of each other and are otherwise identical. Each column 2, 3 comprises a lower member 14; 15 which is rigidly secured to the relevant extension arm 9; 10, and an upper member 16; 17 supported by the lower member 14; 15. The two members are arranged to be moved a restricted distance in relation to each other along the centre axis 18; 19 of the column. Each column 2, 3 is provided with a locking and supporting unit 20; 21 rigidly mounted to and above the upper member 16; 17 and having a bearing housing 22; 23 for a locking means in the form of a specially designed, downwardly directed locking pin 24; 25. The locking pin is located outside and at a predetermined distance from the vertical front surface 26; 27 of the column (facing away from the truck and towards the container 7), as can be seen more clearly in FIG. 6. The centre axis 28 of the locking pin 24; 25 is thereby parallel to the centre axis 18; 19 of the column. Furthermore, the locking pin is turnably journalled in the bearing housing 22; 23 and can be turned 90° between two end positions by means of a hydraulic cylinder 29; 30 mounted to the locking and supporting unit 20; 21. In one end position the locking pin is free from engagement with the top corner fitting 31; 32 of the container (FIGS. 7 and 8), whereas in the other end position it is in engagement with the top corner fitting 31; 32. Above the bearing housing 22; 23 there is an indicating means 33; 34 having sides of different colours and being connected to the locking pin 24; 25 to be turned together with this. The indicating means are thus arranged to function as flags visible from the driver's seat of the truck to indicate whether the locking pins 24; 25 are in locking or released position. Furthermore, each bearing housing 22; 23 is provided with a safety peg 35 protruding downwardly out of the bearing housing to cooperate with the upper surface of the container corner fitting 31; 32 and thus be pressed into an inner position. In extended position the safety peg 35 is arranged to prevent the locking pin 24; 25 from turning and in inserted position, it prevents the locking pin from being turned from its locking engagement with the top corner fitting while the lifting is in progress.

Figure 6:
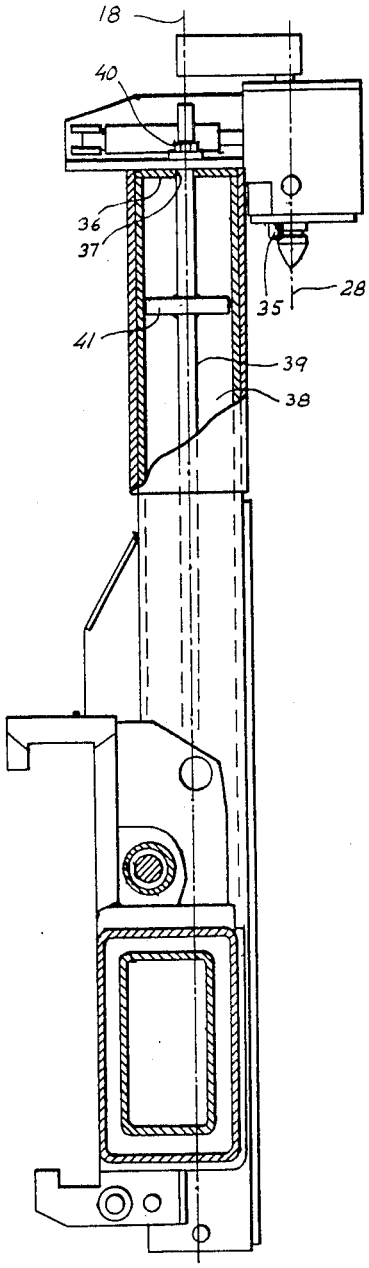
FIG. 6 is a view along the line VI—VI in FIG. 1 and shows the lefthand column slightly enlarged and partly cut open.

The upper member 16; 17 is fixed against turning about the centre axis 18; 19 of the column. In the embodiment shown, such turning is prevented since the members 14, 16; 15, 17 of the columns have square cross section. The upper member 16; 17 is thereby telescopically journalled outside the lower member 14; 15 which is hollow but closed at the top or provided with a stop 36 having a central aperture (FIG. 6). An elongate draw bar 39 is arranged in the space 38 of column 2; 3, and extends up through the aperture 37 of the stop 36. The upper end part of the draw bar 39 is thereby threaded to enable the assembly of the locking and supporting unit 20; 21 thereto above the upper member 16; 17 of the column with the aid of a nut 40 after having the draw bar 39 passed through the bottom of the locking and supporting unit 20; 21. The draw bar 39 is provided with a stop 41 arranged at a predetermined distance from the stop 36 when the upper member 16; 17 is in its lowermost position in relation to the lower member 14; 15. The stop 41 of the draw bar 39 is arranged to cooperate with the stop 36, and its engagement means 36, 41 prevent thereby continued axial movement of the lower member 14; 15 in a direction away from the upper member 16; 17, which is restrained by the container. The total displacement of the lower member 14; 15 thus corresponds to said greatest distance between the stop 41 and the stop 36.

A tension spring 42 is also mounted in the space 38 of the column. This spring is connected by one end to the lower member 14; 15 of the column and by the other end to the lower end of the draw bar 39, which is curved to form a hook. The tension spring 42 is arranged to be forcibly withdrawn and tensioned when the upper member 16; 17 of the column and the lower member 14; 15 of the column are displaced from each other so that a tensile force is produced in the locking pin 24; 25 which is beneficial to the connection.

The front surfaces 26, 27 of the columns are free from protrusions or the like and are entirely flat so as to form support surfaces for the container. This eliminates the need for the height of the side lifting apparatus to be specially adjusted and enables it to fit containers of different heights, e.g. 8, 8.5, 9 and 9.5 feet. The support surfaces also have the essential advantage that the risk of damage to the container is reduced. Furthermore, the space between the columns 2, 3 is entirely free from construction elements and the driver therefore has a good view of the positions of the locking pins in relation to the top corner fittings when the side lifting apparatus is being manoeuvred towards the container. The construction of the columns means that the locking and supporting units 20, 21 are suspended telescopically and resilient in relation to the main girder which considerably facilitates connection to an inclined container. The relative movement of the column members can be up to about 400 mm, for instance 250 mm. The invention thus eliminates the conventional hydraulically controlled turning or bevelling of the entire side lifting apparatus about a central fixed pivot.

Figure 7:
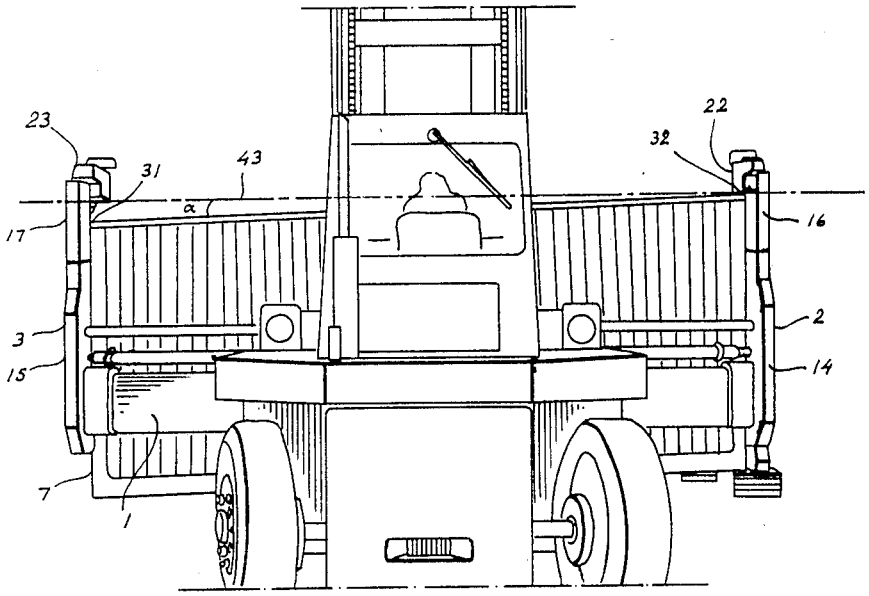
FIGS. 7 and 8 illustrate the operation of the side lifting apparatus carried on a truck, for connection with an inclined container.
Figure 8:
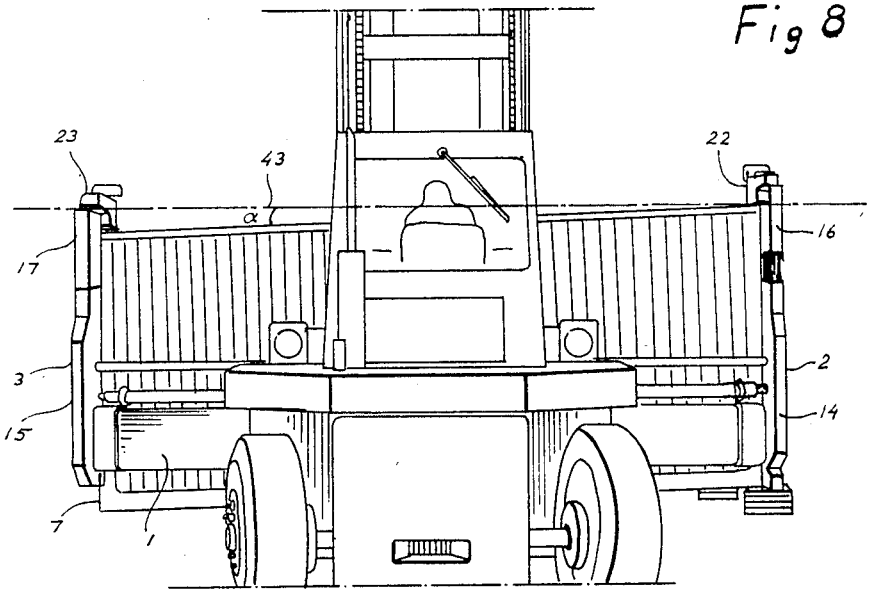

The described side lifting apparatus is used primarily in the following manner when handling a container which is placed with an inclination in relation to the support surface on which the truck is being driven. The connection is illustrated in FIGS. 7 and 8 and the support surface carrying the truck is parallel to a plane 43 which may be termed the horizontal plane. The container 7 can form an angle $\alpha$ of up to about 5° to this plane. The distance between the locking pins 24, 25 is adjusted to fit the distance between the holes in the top corner fittings 31, 32 of the standardized container by extending the extension arms 9, 10 and corresponding parallel displacement of the columns 2, 3. The side lifting apparatus is manoeuvred in towards one longitudinal vertical side of the container after having been raised to the correct level on the lifting stand of the truck so that both locking pins 24, 25 will be free from the container. When the flat support surfaces 26, 27 of the columns 2, 3 are in contact with the container, the entire side lifting apparatus can be lowered, whereupon the righthand locking pin 24 will be inserted into the righthand top corner fitting 32 which is located at a higher level than the lefthand top corner fitting 31. During continued lowering of the side lifting apparatus the upper member 16 of the righthand column 2 will be retained at the container in that the righthand bearing housing 22 is abutting the container. The lowering is continued under control and under tension from the tension spring 42, until the bearing housing 23 of the lefthand column 3 has been brought into contact with the container, at the same time as its locking pin 25 is inserted into the lefthand top corner fitting 31, as is shown in FIG. 8, and the lower member 14 of the righthand column is displaced downwardly from the upper member 16 retained by the container. Provided that both safety pegs 35 have been driven in, the locking pins can then be turned, by connecting the hydraulic cylinders 29, 30, a quarter of a turn to their locking positions which are indicated by flags 33, 34. The tension spring 42 in the righthand column 2 has now been extended in a corresponding amount as this column has been lengthened. The container locked in this manner, can then be lifted by the side lifting apparatus to the desired level and transported to the desired storage place. When the side lifting apparatus is lifted up by the lifting stand of the truck, the upper member 16 of the righthand column will be moved back to its initial position in relation to the lower member 14. If, when lowering is initiated in the example shown, the righthand locking pin 24 is not vertically aligned with the hole in the top corner fitting 32, the locking pin 24 will instead come into contact with the container and usually its top corner fitting 32. The displacement of the column members 14 and 16 from each other takes place as described earlier, at the same time as a tensile force is built up in the upper member 16 as the tension spring is extended. If the locking pin 24 abuts with its bevelled or conical surfaces against the edges of the hole, it will be guided towards the centre of the hole due to the increasing tensile force built up in the tension spring 42, and will finally be forcibly pulled down into the hole by the tension spring, which is usually partially extended at this stage. If, however, the point of the locking pin is outside the edges of the hole, the lowering of the side lifting apparatus must be discontinued in order to alter its position in relation to the container. When the side lifting apparatus is lifted, therefore, the fully or partially extended spring will assist in more quickly returning the upper member 16 of the column 2 to its initial position (FIG. 1) so that the upper member does not remain suspended in a protruding position. Instead of lifting the entire side lifting apparatus, the locking pin in certain cases may be displaced laterally by connection of the hydraulic cylinder 11.

The described side lifting apparatus can be operated and connected to an inclined container in an extremely simple, reliable and fast manner, thanks to its special design which results in a side lifting apparatus having low weight and a low centre of gravity as well as free visibility for the truck driver and the possibility of individual level adjustment of the locking pins, thanks to the individually extendable columns. Furthermore, the side lifting apparatus fits containers of different heights without the need for adjustment, since the front surfaces of the columns can be used as support surfaces in that the locking pins are no longer on the main girder and the front surface of the main girder is in the same plane as said support surfaces or slightly behind them. The arrangement of the independently displaceable or extendable columns is also advantageous when the container is to be placed on an intended place which causes the container to incline somewhat in relation to the ground on which the truck is being driven. Since one of the columns is extended when the container comes into contact with the inclined surface, uneven loading of the side lifting apparatus is prevented, which would otherwise cause exhaustion and breakage in the construction.

The side lifting apparatus according to the invention can be modified and altered in many ways within the scope of the following claims. A force transmitting means other than a spring may be used to affect the upper member of the column, such as a hydraulic cylinder or a pressure chamber, in which a pressure is built up while the members of the column in question are displaced from each other, whereby the increased pressure can then be used to forcibly pull down an obliquely aligned locking pin into the hole of the top corner fitting, and to more quickly return the upper member to the lower member of the column in the same way as with the spring described. Alternatively, the spring or other force transmitting means may be omitted in certain cases. In the embodiments described the columns are arranged to be freely extended but a restricted distance independently of each other due to the external influence of the contact with one top corner fitting of the container and lowering of the side lifting apparatus, so that an automatic adjustment of the levels of the locking pins to the inclination of the container is obtained in an advantageous manner. However, it lies within the scope of the invention to control the extension of the columns by means of hydraulic cylinders, for instance, controlling the movement of the column members both away from and towards each other, whereby the hydraulic cylinders can be connected or disconnected individually, either manually or automatically, for instance by means of contact means arranged at the bearing housings, which indicate the highest and lowest levels of the inclination of the container.

That which is claimed is:

1. A side lifting apparatus for detachable connection to a container and arranged to be supported by the lifting stand of a fork truck to be raised and lowered along said lifting stand, and comprising a horizontal main girder and two vertical columns directed upwardly from the girder and rigidly mounted to its ends, each of said columns carrying a bearing housing having a downwardly directed locking pin arranged turnably in the bearing housing to be brought into locking engagement with a top corner fitting of the container, each of said columns comprising an upper member carrying said locking pin and a lower member rigidly mounted to the horizontal main girder, said lower and upper members of each column being relatively axially displaceable to alter the distance of the locking pin to the main girder, whereby to enable, when handling an inclined container, the locking pins to be set at different levels, said different levels corresponding to the inclination of the container.

2. A side lifting apparatus according to claim 1 wherein said members of one column and said members of the other column are displacable independently of each other.

3. A side lifting apparatus according to claim 2 wherein said members are relatively displaced when the bearing housing of a column is impeded from further downward movement from a predetermined level as occurs when the bearing housing during its downward movement by the main girder engages a container.

4. A side lifting apparatus according to claim 3 wherein said two members of each column are arranged to be forcedly urged towards each other by a force transmitting means.

5. A side lifting apparatus according to claim 4 wherein said force transmitting means comprises a spring.

6. A side lifting apparatus according to claim 5 wherein said tension spring is attached to the lower member and to the upper member of the column via a draw bar.

7. A side lifting apparatus according to claim 6 wherein said draw bar is provided with a stop to cooperate with a stop on the lower column member to limit the relative axial displacement of the column members.

8. A side lifting apparatus according to claim 1 wherein the side surfaces of the columns facing the container are flat and arranged to serve as support surfaces for the container.

9. A side lifting apparatus according to claim 1 wherein the apparatus is entirely free from vision-impeding construction elements in the space between the vertical columns.

10. A side lifting apparatus according to claim 1 wherein said column members are axially displaceable a limited distance of up to 400 mm in relation to each other.

* * * * *